US009565723B2

(12) United States Patent
Cappitelli et al.

(10) Patent No.: US 9,565,723 B2
(45) Date of Patent: Feb. 7, 2017

(54) DEVICE AND METHOD FOR GENERATING LIGHT OF A PREDETERMINED SPECTRUM WITH AT LEAST FOUR DIFFERENTLY COLORED LIGHT SOURCES

(71) Applicant: EADS Deutschland GmbH, Ottobrunn (DE)

(72) Inventors: Mario Cappitelli, Hamburg (DE); Sönke Klostermann, Mittelnkirchen (DE); Dietmar Vogt, Neu Wulmstorf (DE); Michael Olbert, Jork (DE)

(73) Assignee: Airbus Defence and Space GmbH, Ottobrunn (DE)

( * ) Notice: Subject to any disclaimer, the term of this patent is extended or adjusted under 35 U.S.C. 154(b) by 67 days.

(21) Appl. No.: 13/972,254

(22) Filed: Aug. 21, 2013

(65) Prior Publication Data

US 2014/0055038 A1 Feb. 27, 2014

(30) Foreign Application Priority Data

Aug. 22, 2012 (DE) ..... 10 2012 107 706

(51) Int. Cl.
*H05B 33/08* (2006.01)

(52) U.S. Cl.
CPC ..... *H05B 33/08* (2013.01); *H05B 33/0869* (2013.01)

(58) Field of Classification Search
CPC ..... H05B 33/0863; H05B 33/0857; H05B 33/0869; H05B 37/02; H05B 37/029; H05B 35/00; H05B 33/08
USPC ..... 315/150, 151, 152; 250/201.1, 205
See application file for complete search history.

(56) References Cited

U.S. PATENT DOCUMENTS

2006/0006821 A1* 1/2006 Singer ..... H05B 33/0869 315/312
2008/0013314 A1 1/2008 Ashdown et al.
2009/0090843 A1 4/2009 Lim et al.
2010/0301777 A1 12/2010 Kraemer

FOREIGN PATENT DOCUMENTS

DE 10 2007 044 556 A1 3/2009
DE 10 2008 050 818 A1 4/2009
EP 1461982 B1 9/2004
WO WO 2010/122312 A1 10/2010

* cited by examiner

*Primary Examiner* — John Poos
(74) *Attorney, Agent, or Firm* — Hoffmann & Baron, LLP

(57) ABSTRACT

A lighting device and method with a lighting unit which includes several light sources having different color spectra, with a sensor for determining the spectral power distribution emitted by the lighting unit, with a control unit which, as a function of a predetermined spectral power distribution as well as of the spectral power distribution measured by the sensor, acts on a drive unit which individually energizes the light sources of the lighting unit, so that the emitted light has predetermined spectral power distribution, wherein the lighting unit includes at least four light sources, and the control unit uses an optimization algorithm which, as an optimization goal, maximizes a coefficient of weighted sensor values, the coefficient being calculable from individual drive data of the light sources. A secondary condition is met when error between the predetermined spectral power distribution and the measured spectral power distribution is smaller than a limit value.

16 Claims, 1 Drawing Sheet

DEVICE AND METHOD FOR GENERATING LIGHT OF A PREDETERMINED SPECTRUM WITH AT LEAST FOUR DIFFERENTLY COLORED LIGHT SOURCES

CROSS-REFERENCE TO RELATED APPLICATIONS

The present application claims priority to German Patent Application Ser. No. 10 2012 107 706.1, filed on 22 Aug. 2012, the contents of which are incorporated herein by reference in their entirety.

BACKGROUND

Field of Technology

The present application relates to a lighting device with a lighting unit including several light sources having different color spectra, with a sensor for determining the spectral power distribution (SPD) emitted by the lighting unit, with a control unit which, as a function of a predetermined spectral power distribution as well as of the spectral power distribution measured by the sensor, acts upon a drive unit which individually energizes the light sources of the lighting unit, so that the emitted light has the predetermined spectral power distribution. In this context, color spectrum denotes the electromagnetic waves of a range of defined bandwidth and intensity in the color space visually perceivable to humans.

The present application further relates to a method for operating a lighting device with a lighting unit which comprises at least four light sources having different color spectra, with a sensor for determining the spectral power distribution (SPD) emitted by the lighting unit, a control unit which, as a function of a predetermined spectral power distribution as well as of the spectral power distribution measured by the sensor, acts upon a drive unit which individually energizes the light sources of the lighting unit, so that the emitted light has the predetermined spectral power distribution.

Brief Description of Related Art

In semiconductor based lighting elements, such as LEDs, the color spectrum and the brightness (intensity) change with increasing operation duration, which can be perceived as interference unless compensation is provided for this interference. In addition, LEDs are also affected by a dispersion of their technical properties with regard to brightness and color during manufacture. This is compensated for by the manufacturer using so-called "binning," in which semiconductor elements are sorted according to a predetermined dispersion. The narrower the dispersion selection, the more expensive are the LEDs.

A device is known from EP 1 461 982 B1, in which a desired light color is generated from three LED light sources with red, green and blue color spectra. In the process, the light emitted by the three LEDs is detected by a three-section filter, the measured RGB value is converted to the so-called CIE XYZ color space (CIE=Commission internationale de l'éclairage [International Commission on Illumination]). This measured value vector is compared in a control unit which functions as a P controller with an XYZ target value, which, depending on the error, acts upon a drive unit, which controls the electrical power supplied to the light sources accordingly. By means of such a device, compensation for such changes in the brightness and color can be provided.

However, the disadvantage here is that, on the one hand, the sensor has to be adjusted to the frequency spectra of the LEDs for the control unit to function sufficiently. Furthermore, with this system, a lighting device with more than 3 light sources having different color spectra—for example, a yellow or white LED as fourth LED—can no longer be controlled, because the result of this control is no longer unequivocal, since several luminosity settings of the four light sources can generate the same color impression in the XYZ color space.

DE 10 2007 044 556 describes a method for determining the light current components of individual LEDs via a v(lambda)-adapted sensor. The operationally conditioned color and brightness changes of the individual LEDs are determined by a measuring of the spectral component with the aid of a v(lambda)-adapted sensor and the measuring of the operating temperature of the LED (board and junction temperature). These measured values are determined individually for the particular controlled LED. The measured values then flow as input parameters of the determination of the individual emission spectra to the LED that can then be optimized regarding light current so that the entire light achieves a defined color and brightness. This has the disadvantage that only one individual light source can always be observed by the measuring method used. Even a detection of the color shift of an individual light source can be determined only indirectly with the information of the temperature and of the v(lambda) measuring. Non-temperature-dependent color changes of the light source cannot be differentiated with this from a change in brightness. It is also disadvantageous that the described adjustment of the color and brightness values of the light function only in one operating state in which the individual light sources are adjusted individually. This equals an interruption of the operation.

SUMMARY

The aim of the present application is to provide a lighting device, which is characterized in that more than 3 lighting elements having different color spectra and brightness values can be integrated, and, in the process, largely any desired color spectrum can be used. Here, it should be possible to use a three-channel sensor of simple design. Furthermore, the present application aims to provide a method for driving a lighting device with more than three light sources having different color spectra. The sensor should measure all light sources at the same time and determine a color and brightness measured value for the entirety of the light sources used.

These aims are achieved by the characteristics of the independent claims. Advantageous variants and embodiments of the present application are the subject matter of the dependent claims. Additional characteristics, application possibilities and advantages of the present application can be obtained from the following description, and from the explanation of the embodiment examples, which are represented in the figures.

The first mentioned aim is achieved in that the lighting unit includes at least four light sources, and the control unit is arranged for using an optimization algorithm which, as a main condition, maximizes a calculated weighting criterion, such as the color rendering index (CRI), in particular, which can be calculated from the individual drive data of the light sources, and which has a stop criterion which is that the error between the predetermined and the measured spectral power distribution is smaller than a limit value.

A particular circumstance here is the fact that the resulting control values of the individual light source are not known.

Only the impression of the color and brightness of the entirety of the light sources is considered. This can take place without interruption during the operation of the light. It is also ensured that all intrinsic and extrinsic influences on the color and brightness change can be compensated, in particular since a redundancy in determination regarding the color impression is generated by the using of at least four light sources that can be used as compensation source. Furthermore, a provided control reserve serves as source for further compensation of color and brightness changes. Thirdly, a color adaptation can also take place under reduction of the total brightness of the light in that the optimization is carried out in a color space such as CIE xy that is not affected by brightness instead of in an XYZ color space affected by brightness.

To the extent that light sources are referred to in the context of this application, the term refers to any desired lighting element, particularly any type of light emitting diode, including organic light emitting diodes (OLED). It is also possible to use light sources of different type together, in particular LEDs and incandescent light bulbs.

Although the main field of application of the device according to present application is the range of visible light, the usability of the device explicitly also includes the infrared and ultraviolet ranges. Thus, individual light sources or all the light sources can have frequency spectra that are partially or completely outside of the range of visible light. Moreover, in the infrared or in the UV range, they can be set with a sensor channel number that is smaller than the number of control variables with the aid of the optimization method to defined target parameters.

The idea of the present application is to carry out the setting of the light sources used, not by means of a conventional control circuit, but by using an optimization method that includes two or more optimization criteria. On the one hand, the optimization goal is to maximize a coefficient of weighted sensor values, in particular a color rendering index CRI (Color Rendering Index), which is not calculated from measured light values but instead from the drive data for the individual light sources. The second optimization criterion or secondary condition is to minimize the deviation measured by the sensor, in the color spectrum in the defined color space of the sensor. Since the present lighting unit example requires a high CRI, the CRI has also been used as optimization criterion here. Depending on the requirement associated with the lighting unit system, other criteria can also be implemented for the optimization. Other possible optimization criteria can be selected taking into account the properties of individual light sources. For example, the protection of particularly susceptible light sources by minimizing the power demand can be used.

The drive data are transferred typically according to the DMX protocol or a similar protocol. The DMX protocol allows a setting of the driver current for each light source with a precision of 8 bit (that is 256 different values). Instead of the DMX protocol, other protocols can naturally also be used, for example, protocols with higher precision. It is preferable to provide a control reserve of, for example, one additional bit, in order to appropriately take into consideration the decrease in brightness occurring as a result of aging processes.

From the current DMX value of a light source, on the basis of data stored for the light source, an associated spectrum is calculated, which is added to the calculated spectra of the other light sources to form a jointly calculated "predicted" or "virtual" total spectrum. From this calculated total spectrum, the CRI value $R_a$ is calculated in the usual manner, as in the case of measured spectral values. It is preferable for this calculation to occur in the CIE system. The optimization system according to the present application uses this calculated CRI value $R_a$ as main criterion. Since many algorithms can only be minimized, but the negated minimum is the maximum, the main condition or target function can also be defined as follows:

$$\mathrm{mn}((-R_a(x))$$

As secondary condition, the present application requires minimizing a difference vector obtained from the measured color vector (preferably in the XYZ system) and a predetermined (target) vector. For the optimization system to achieve a solution in real time, it is predetermined as stop condition that the magnitude of the difference vector falls below a limit value $\epsilon$. The secondary condition can thus be defined as follows:

$$\left|\overrightarrow{XYZ}_{actual} - \overrightarrow{XYZ}_{target}\right| \cdot \leq \varepsilon$$

In this manner, the manufacture- and aging-related changes in color and brightness of the lighting device according to the present application can be compensated, in order to ensure a uniform lighting quality throughout the entire time of operation. The system according to the present application allows an optimized setting of the lighting for any desired number of light sources (LEDs). The continual adaptation of color and brightness here allows the selection of more cost effective light sources (that is of a cost effective "binning") with simultaneously increased lighting quality. It should be noted that the optimization method can include more secondary conditions, in particular a high color saturation.

According to an advantageous variant of the present application, the lighting unit comprises 4 light sources with different spectral emission, particularly preferably with a selection from the colors red, green, yellow, blue, and white. The selection of the light sources is made depending on the use of the lighting device. Alternatively, it is also possible to use five or more light sources in all the mentioned colors or spectral values.

According to an advantageous variant of the present application, the control algorithm can be implemented in the CIE-standardized X, Y, Z color space. This has the advantage that, using a simple three-channel sensor provided with suitable standardized filters, the entire color space perceivable by humans can be detected.

Alternatively, it is also possible to use other color spaces, for example, RGB, LUV, HSL, LMS, and RG, wherein the given limitation of the gamut has to be taken into consideration.

According to advantageous variant of the present application, the sensor is a three-channel sensor which provides data preferably in the RGB or XYZ format. The optimization according to the present application can be carried out by means of a very simple and cost effective sensor. This sensor determines the light current and the color location of the entirety of all light sources used in the lighting unit.

The aim of the present application is achieved furthermore by a method for operating a lighting device with a lighting unit which comprises at least four light sources having different color spectra, with a sensor for the determination of the spectral power distribution (SPD) emitted by the lighting unit, with a control unit which, as a function of a predetermined spectral power distribution as well as of the spectral power distribution measured by the sensor, acts upon a drive unit which individually energizes the light sources of the lighting unit, so that the emitted light has the predetermined spectral power distribution, wherein the method is designed as an optimization algorithm which, as main condition, maximizes a calculated color rendering index (CRI), which is calculated from the individual drive data of the light sources, and, as secondary condition, the optimization is stopped when the error between the predetermined and the measured spectral power distribution falls below a limit value. The principle of operation and the advantages of the method have already been explained above in connection with the device.

According to an advantageous variant, the so-called simplex method is used as an optimization method. This is a proven optimization method for solving linear optimization problems. Alternatively, other optimization methods can also be used.

According to an advantageous variant, the color rendering index (CRI) is calculated from stored data via the spectra of the individual light sources as well as the drive data of the light sources.

It is advantageous here to use a function between the respective maximum of a spectrum and the radiation intensity, from which a multiplication factor is determined, by means of which the radiation spectrum of a light source at the current drive value of the light source is determined, a radiation spectrum is obtained by adding up the radiation spectra of all the light sources, and from said virtual total radiation spectrum, the calculated color rendering index (CRI) of the virtual total radiation spectrum is determined.

Additional advantages, characteristics and details result from the following description in which—in reference to the drawing—at least one embodiment example is described in detail. Identical, similar and/or functionally equivalent parts are provided with identical reference numerals.

DETAILED DESCRIPTION

Figure 1:
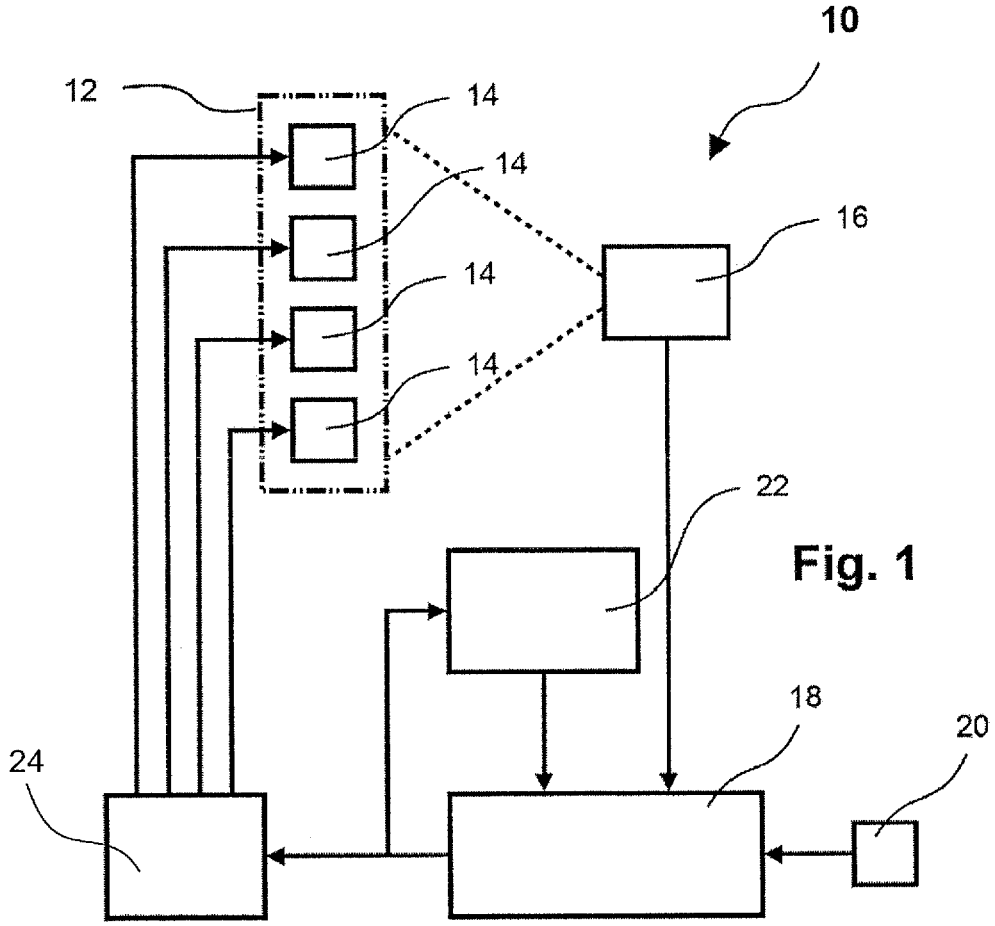
FIG. 1 shows a diagrammatic block diagram representation of the device according to the present application.

The device 10 according to the present application comprises, according to FIG. 1, a lighting unit 12 which comprises four or more light sources 14 which have different color spectra. For example, a red LED (620 nm), a green LED (520 nm), a blue LED (460 nm), and a yellow LED (590 nm) can be provided. Furthermore, to increase the luminosity, several light sources of the same color spectrum can be provided, which are preferably energized jointly (in parallel or in series), but which are considered to be a light source or LED in the context of this embodiment. These light sources emit substantially in the same direction which is not further designated here. It is essential that, in the radiation field of all the light sources, a sensor 16 is arranged, which is preferably designed as an RGB or XYZ sensor, and which transfers corresponding data of the received radiation spectrum to an optimization unit 18. The optimization unit 18 furthermore contains, as input signal, a radiation target value 20 as spectral power distribution (SPD), here as a vector in the XYZ color space. Furthermore, the optimization unit 18 receives a calculated CRI value which should correspond to the current actual CRI value of the lighting unit 12, and be provided by a CRI value calculation unit 22. The mode of operation of the CRI value calculation unit 22 is explained further in FIG. 2. The optimization unit 18, on the basis of the mentioned data inputs, carries out an optimization process, preferably according to the so-called simplex method, and it calculates drive values (preferably in the DMX protocol) which, in the asynchronous serial operation, are transferred to a drive unit 24 which, on the basis of the drive values, individually energizes the light sources 14 of the lighting unit 12.

Here, the main condition of the optimization method is a maximization of the calculated CRI value $R_a$ which is provided on the basis of the CRI value calculation unit 22:

$$\max(R_a)$$

As secondary condition, a difference vector from the color vector measured by the sensor 16 (preferably in the XYZ system) and a predetermined (target) vector 20 is minimized. For the optimization system to reach a solution in real time, it is predetermined as stop condition that the magnitude of the difference vector falls below a limit value $\epsilon$:

$$\left|\overrightarrow{XYZ}_{actual} - \overrightarrow{XYZ}_{target}\right| \cdot \leq \varepsilon$$

Figure 2:
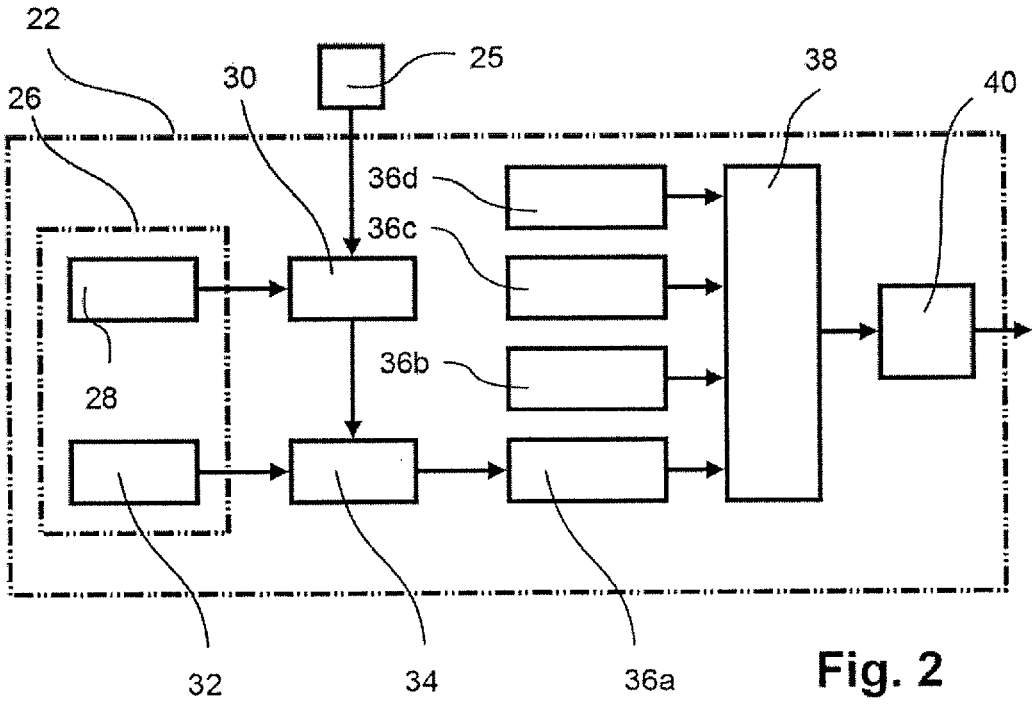
FIG. 2 shows a diagrammatic block diagram representation of the CRI value calculation unit.

In FIG. 2, the principle of operation of the CRI value calculation unit 22 is explained in greater detail. The calculation unit 22 obtains, as input signal, the current drive data 25 for the light sources, of which only one is represented in FIG. 2. Since the data transfer occurs serially, the drive data of the other light sources are supplied consecutively, and processed in the CRI value calculation unit 22. In a storage unit 26, for each light source, in a first storage area 28, a relation between the maximum of the spectrum of a light source in relation to the drive value in question (DMX) is stored. In the first approximation, this is a straight line; however, to increase the precision, it can be approximated by a polynomial function of third degree, for which, as determining data for the light source in question, the four coefficients a, b, c, d are recorded in $$k=aDMX^3+bDMX^2+cDMX+d$$

(DMX stands for the independent variable, that is the associated DMX value of the light source). Alternatively, the relation between the DMX value and the maximum of the spectrum can also be designed as a lookup table, in order to represent the relation with even greater precision. In the course of the design of the entire lighting unit for the respective lamp type (light source) used, the coefficients a, b, c and d are determined individually with the aid of a spectral measurement or on the basis of the data sheets.

A polynomial function calculation unit 30 calculates a multiplier k (k<1) from the DMX drive value 25 of the light source and from the coefficients present in the first storage area 28.

The storage unit 26 contains, for each light source, a second storage area 32 in which the spectrum of the light source at maximum luminosity is stored as a lookup table. A multiplier unit 34 multiplies, using the multiplier k determined in the polynomial function calculation unit 30, and the light spectrum of the light source in question, which is stored in the second storage area 32, to get the current individual spectrum of the light source 36*a*, which is added in the addition unit 38 to the individual spectra of the other light source 36*b*-36*d*, which were calculated in the same manner, a total spectrum. The resulting calculated total spectrum of all the light sources 14 is converted in the CRI unit 40 according to a known algorithm into the color rendering index value CRI. This value is then supplied to the optimization unit 18 shown in FIG. 1.

LIST OF REFERENCE NUMERALS

10 Device;
12 Lighting unit;
14 Light sources;
16 Sensor;
18 Optimization unit;
20 Radiation target value;
22 CRI value calculation unit;
24 Drive unit;
25 DMX drive data;
26 Storage unit;
28 First storage area;
30 Polynomial function calculation unit;
32 Second storage area;
34 Multiplier unit;
36*a-d* Individual spectrum;
38 Addition unit; and
40 CRI unit.

The invention claimed is:

1. A lighting device comprising:

a lighting unit comprising at least four light sources, each light source having a different color spectra;

a color rendering index calculation unit to calculate a color rendering index based on stored data on spectra of the light sources and individual first drive data for the light sources;

a drive unit to individually energize the light sources of the lighting unit according to the individual first drive data;

a sensor to measure a spectral power distribution emitted by the lighting unit;

a control unit configured to:

receive the spectral power distribution, a predetermined spectral power distribution, and the color rendering index associated with weighted sensor values calculable from the individual first drive data;

maximize the color rendering index according to a condition that an error between the predetermined spectral power distribution and the measured spectral power distribution is smaller than a limit value;

determine individual second drive data based on the color rendering index as maximized; and act on the drive unit such that the light sources of the lighting unit are individually energized according to the individual second drive data.

2. The lighting device according to claim 1, wherein at least a portion of the light sources includes semiconductor-based light sources.

3. The lighting device according to claim 2, wherein at least a portion of the semiconductor-based light sources includes light emitting diodes.

4. The lighting device according to claim 1, wherein the lighting unit comprises four light sources with different spectral emission.

5. The lighting device according to claim 4, wherein the lighting unit comprises four light sources with a selection from colors red, green, yellow, blue, and white.

6. The lighting device according to claim 1, wherein the lighting unit comprises five light sources.

7. The lighting device according to claim 1, wherein maximization of the color rendering index is implemented in the CIE standardized X, Y, Z color space.

8. The lighting device according to claim 1, wherein the sensor is a three-channel sensor.

9. The lighting device according to claim 1, wherein the sensor is an RGB or an XYZ sensor.

10. The lighting device according to claim 1, wherein the individual first drive data and the individual second drive data are encoded according to a DMX protocol.

11. A method of operating a lighting device with a lighting unit comprising at least four light sources, each light source having a different color spectra, a color rendering index calculation unit to calculate a color rendering index, a sensor to measure a spectral power distribution emitted by the lighting unit, a control unit configured to receive the spectral power distribution, a predetermined spectral power distribution, and the color rendering index associated with weighted sensor values calculable from individual first drive data for the light sources, and act on a drive unit to individually energize the light sources of the lighting unit according to individual first drive data, the method comprising:

calculating the color rendering index based on stored data on spectra of the light sources and the individual first drive data;

maximizing the color rendering index associated with the weighted sensor values calculable from the individual first drive data; and stopping maximization when an error between the predetermined spectral power distribution and the measured spectral power distribution falls below a limit value.

12. The method according to claim 11, wherein the method uses a simplex method associated with maximization of the color rendering index.

13. The method according to claim 12, wherein the method comprises:

using a function between a respective maximum of a spectrum and a radiation intensity to determine a multiplication factor from which a radiation spectrum of an LED at a current LED drive value is determined;

adding radiation spectra of all the light sources into a virtual total radiation spectrum; and determining the color rendering index from the virtual total radiation spectrum.

14. The method according to claim 11, wherein the function is a polynomial function of a third degree, wherein coefficients of the function for each LED are stored.

15. The method according to claim 11, wherein the method further comprises determining individual second drive data based on the color rendering index as maximized.

16. The method according to claim 15, wherein the method further comprises acting on the drive unit such that the light sources of the lighting unit are individually energized according to the individual second drive data.

* * * * *